US005465665A

United States Patent [19]

Diehl

[11] Patent Number: 5,465,665

[45] Date of Patent: Nov. 14, 1995

[54] PRIMER

[75] Inventor: Steven F. Diehl, Mulberry, Fla.

[73] Assignee: Olin Corporation, St. Petersburg, Fla.

[21] Appl. No.: 145,891

[22] Filed: Oct. 29, 1993

[51] Int. Cl.[6] ..... F42B 5/26; C06C 7/00

[52] U.S. Cl. ..... 102/470; 102/202; 102/204

[58] Field of Search ..... 102/202, 204, 102/380, 430–433, 466, 467, 469, 470, 472, 202.5, 202.14; 60/256

[56] References Cited

U.S. PATENT DOCUMENTS

| | | | |
|---|---|---|---|
| 45,666 | 12/1864 | Yates | 102/470 |
| 2,436,826 | 3/1948 | Regad et al. | 102/204 |
| 3,151,447 | 10/1964 | Bornstein | 102/202 |
| 3,224,373 | 12/1965 | Kramer | 102/470 |
| 3,482,518 | 12/1969 | Sweetman | 102/202.14 |
| 4,149,465 | 4/1979 | Verkozen | 102/202 |
| 4,524,670 | 1/1985 | Billard et al. | 102/340 |
| 4,770,099 | 9/1988 | Brede et al. | 102/472 |
| 5,005,486 | 4/1991 | Lenzen | 102/202.5 |
| 5,052,302 | 10/1991 | Taddeo et al. | 102/204 |
| 5,341,638 | 8/1994 | Van Name et al. | 60/204 |

FOREIGN PATENT DOCUMENTS

| | | | |
|---|---|---|---|
| 2835 | of 1883 | United Kingdom | 102/470 |

*Primary Examiner*—Harold J. Tudor
*Attorney, Agent, or Firm*—Gregory S. Rosenblatt

[57] ABSTRACT

A primer including a primer head assembly and a hollow tubular one-piece body attached thereto. The outer surface of the body tapers to its smallest diameter at the forward end thereof and also includes a screw driver tip at its forward end to assist in the insertion of the primer into the propellant charge within the cartridge case as the primer is being attached to the cartridge case. The body is a high temperature, high glass high carbon composite thermoplastic material.

12 Claims, 2 Drawing Sheets

PRIMER

BACKGROUND OF THE INVENTION

1. Field of the Invention

This invention relates generally to primers, and more particularly to an improved design of a bayonet type primer for tank ammunition.

2. Discussion of the Prior Art

Bayonet type primers have been used for many years in tank ammunition. Such tank ammunition comprises a 120 mm cartridge which includes a primer threaded into the base of a cartridge case and embedded into the propelling charge for the round contained within the case.

With the conventional primers, after the propelling charge has been ignited by the primer, the cartridge case base including the steel primer body is ejected into the confines of the fighting vehicle. In the case of the originally designed bayonet type primers, the ejected hot metal tube or body was able to come into contact with an ammunition round that was being held ready for loading after the chambered round was extracted. The ejected round could possibly land on the next round and start a fire within the close confines of the fighting vehicle.

In an attempt to solve this problem, the standard bayonet primers for the 120 mm tank ammunition were coated with silicone rubber (M129 primer) and silica filled rubber (SBR) (M125 primer) to keep them cool to the point that if a round came into contact with an ejected primer, the round would not be ignited. However, this coating is expensive and adds cost to the price of the ammunition round, and also, is subject to variations in processing. The rubber composition is generally formulated in batches and has a short shelf life.

In assembling the conventional bayonet primer to the ammunition round, the primer is threaded into the base of the cartridge case with the tubular portion being embedded into the propellant charge within the case. In some cases, due to the resistance of the propellant charge, it is not possible for the primer to be inserted all the way into the case on the first try whereupon it would be necessary to back out the primer and try to reinsert it. Not only was this operation time consuming, but in some cases the rubber coating would become damaged, rendering the primer unusable.

A typical bayonet type primer includes a primer head which houses the initial firing stage of the round. An ignition element, pressed into place in the confines of the primer head, is charged with a pyrotechnic composition that starts the firing train. The ignition element when activated disperses a flame through a retainer and sets off an explosive charge of black powder. The black powder charge in turn propagates through a closing plug which acts as a directional device to a third charge of Benite, which is comprised mainly of black powder and other pyrotechnic formulations, housed in the primer body. The third charge propagates through holes in the metal primer body initially sealed with a lacquer. This charge, propagating through the primer body, ignites the propelling charge contained in the ammunition case moving the ammunition projectile such as a penetrator out of the gun barrel and to its target.

With this type of arrangement, the process of making the primer according to conventional techniques requires a process step of applying a lacquer to seal the holes in the primer body to protect the pyrotechnic charge from moisture. This also adds to the cost of the round.

SUMMARY OF THE INVENTION

It is an object of the present invention to provide an improved primer of the bayonet type.

It is a more specific object of the present invention to provide a bayonet primer which is capable of being produced at a relatively lower cost than the conventional primers.

Yet another object of the present invention is the provision of a primer requiring fewer process steps in construction.

A still further object of the present invention is the provision of a primer which is more easily inserted into the propellant charge and case base.

According to one aspect of the present invention, a primer in accordance with the present invention may include a primer head assembly adapted to be attached to a cartridge case base. A hollow tubular one-piece body containing an ignition charge is adapted to extend into a propellant charge contained within the cartridge case. The body is connected to said primer head assembly and is comprised of a high temperature composite thermoplastic molded material.

According to another aspect of the present invention, a primer may comprise a primer head assembly adapted to be attached to a cartridge case base and a hollow tubular one-piece body containing an ignition charge which is adapted to be extended into a propellant charge contained within the cartridge case. The body may have rearward portion connected to said primer head assembly and a forward portion having an outer surface tapering to its smallest diameter at the forward end.

BRIEF DESCRIPTION OF THE DRAWINGS

The invention will be better understood by reference to the following detailed description and to the accompanying drawings in which.

DETAILED DESCRIPTION

Figure 1:
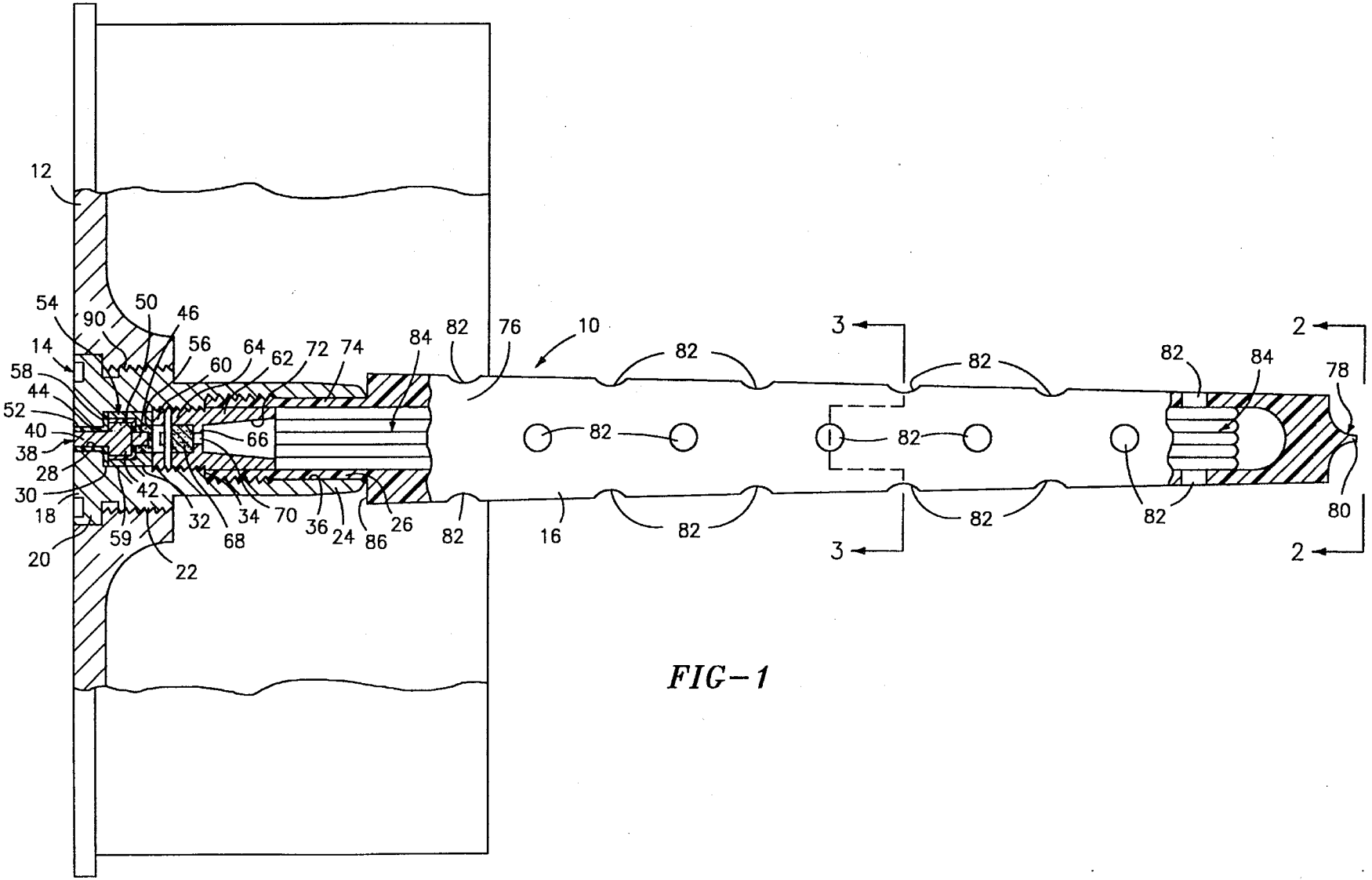
FIG. 1 is a sectional elevation view of a primer constructed in accordance with the present invention shown mounted in a conventional metal cartridge base.

Referring to the drawings, and particularly FIG. 1, the bayonet primer 10 of the present invention is shown mounted in the base 12 of a conventional cartridge case. The primer 10 includes generally a conventional primer head assembly 14 and a hollow elongated body 16.

As the primer head assembly 14 is conventional it will only be briefly described. The primer head assembly 14 includes a metallic primer head housing plug 18 having a flange portion 20 at its aft or rearward end, an intermediate externally threaded portion 22 and a forwardly extending reduced portion 24.

The housing plug 18 has a throughbore 26 therein defined by a rearward reduced cylindrical bore portion 28, a first forwardly facing shoulder 30, a central cylindrical bore portion 32 of a larger diameter than the rearward reduced opening, a second forwardly facing shoulder 34, and a Forward enlarged bore portion 36. The forward portion of the central cylindrical bore portion 32 is threaded and the rearward portion of the forward enlarged bore portion 36 has a threaded portion.

A brass electrode 38 is mounted in the throughbore 26 in the housing plug 18 and includes a rearward cylindrical extension 40 mounted in the reduced rearward bore portion 28 of the housing plug 18. The electrode 38 also includes a central cylindrical body portion 42 positioned in the central cylindrical bore portion 32 of the housing plug. The portion 42 provides a rearwardly facing shoulder 44 facing the first shoulder 30 in the throughbore 26 of the plug 18. The electrode 38 further includes a reduced forward extension portion 46 extending forwardly from the forwardly facing shoulder 50 formed by the central body portion 42. An thin insulator 52 of a suitable material such as polyamide separates the rearward extension 40 and shoulder 44 of the electrode 38 from the reduced cylindrical base portion 28 and first shoulder 30 of the housing plug 18.

A brass ignition cup 54, housing a black powder charge is received within the central bore portion 32 of the throughbore 26 in the housing plug 18 with the black powder charge surrounding the reduced forward extension portion 46 of the electrode 38. The ignition cup includes a bore 58 extending into its rearward end in which the cylindrical body portion 42 of the electrode 38 is positioned when assembled as shown. A thin insulator 59, which also may be of polyamide, separates internal surface of the bore 58 and a shoulder at the bottom thereof from the surface of the cylindrical body portion 42 and shoulder 50 of the electrode. A bridgewire (not shown) may be mounted in the ignition cup 54 and extend through the blackpowder charge and contact the forward extension portion 46 of the electrode 38 which will ignite the black powder charge when an electrical charge is applied to the electrode.

The ignition cup 54 and electrode 38 are retained in place by a brass retainer 60 threadedly received within the central bore portion 32 of the housing plug 18. The brass retainer 60 is tightened against the forward face of the ignition cup to position the shoulder of the cup against the forward shoulder 50 of the electrode and position the rearward shoulder 44 of the electrode against the forward facing shoulder 30 of the throughbore 26 in the housing plug 18.

A brass closing plug 62 has a rearward portion 64 threadedly received within the central bore portion 32 of the throughbore 26 of the housing plug 18 and has a recess 66 opening into its rearward face in which is contained a black powder charge 68 held therein by a paper disc (not shown). An aperture 70 in the bottom of the recess 66 communicates with a frusto-conical interior opening 72 in the forward portion of the closing plug 62.

The hollow elongated body 16 is a one-piece, injection molded hollow member open at its rearward end and closed at its forward end. The body 16 includes a reduced cylindrical threaded rearward portion 74 and a forward portion 76 having an outer surface tapering to its smaller diameter at its forward end. The taper of the portion 76 may be between about 1 to about 2 degrees and preferably about 1.5 degrees.

The body 16 is formed from a high temperature, high carbon, high glass content composite thermoplastic material. Suitable materials include polyetheretherketone (PEEK) and polyphenylene sulfide (PPS), The proportions of the glass and carbon content of the PEEK or PPS material may be varied to optimize the results so that the primer body is relatively cool upon extraction after ballistic firing.

Figure 2:
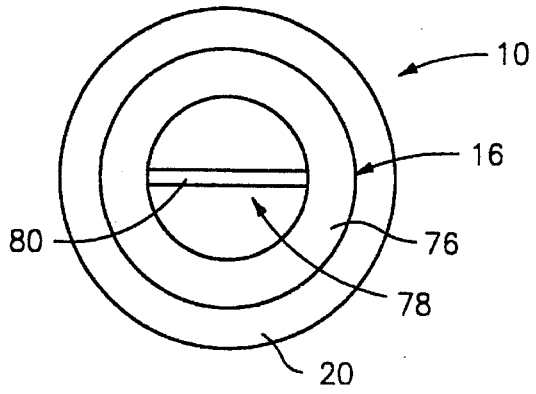
FIG. 2 is an end view of the primer taken in the direction of the lines 2—2 of FIG. 1.

The forward end of the body 16 is provided with a screw driver tip 78 in the form of a blade 80 extending across the forward tip as shown in FIG. 2.

Figure 3:
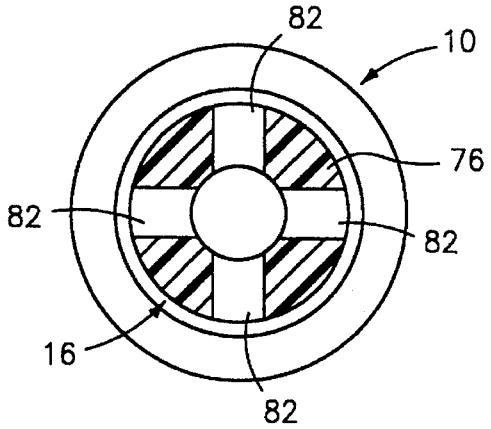
FIG. 3 is a sectional view of the primer taken along the lines 3—3 of FIG. 1.

The tapering portion 76 of the body 16 includes a series of holes or perforations 82 through its wall portion as shown in FIGS. 1 and 3. As shown, the holes 82 extend radially through opposed portions of the side wall of the body 16. The holes 82 are positioned along the length of the tapering portion 76 and are spaced about 1.5 inches apart with adjacent sets of holes being spaced circumferentially 90 degrees from each other.

A pyrotechnic formulation 84 is contained within the hollow interior of the body 16. The pyrotechnic formulation 84 may be graphite coated Benite rods or strands. The reduced rearward portion 74 of the body 16 extends into and is threadedly attached to the threaded enlarged bore portion 36 of the housing plug 18 of the primer assembly 14. The rearward portion 74 of the body 16 surrounds the closing plug 72. The outer diameter of the tapering portion 76 of the body 16 at its rearward end is larger than the outer diameter of the forwardly extending reduced portion of the housing plug 18. The pyrotechnic formulation 84 extends from a point immediately adjacent the forward end of the closing plug 62 forwardly within the body 16.

In operation, upon an electrical charge being applied to the electrode 38 of the primer head assembly 14, the bridgewire will ignite the ignition charge 56 which disperses a flame through an aperture in the retainer 60 and ignites the black power charge 68 in the recess 66 of the closing plug 62. This black powder charge, upon ignition, produces a flame which propagates through the aperture 70 in the closing plug 62 and is dispersed by the frusto-conical opening 72 causing the ignition of the pyrotechnic formulation 84 contained within the in the body 16. The ignition of the pyrotechnic formulation 84 produces a flame which propagates through the holes 82 in the body 16 igniting the propellant charge contained within the cartridge case which in turn imparts a propelling force to the projectile to propel the projectile out of the gun barrel.

In the fabrication of the primer, the tubular body 16 is made as a separate member. This member 16 is injection molded as a one-piece member using conventional injection molding techniques. The primer head assembly 14 is fabricated and loaded with its components in the conventual manner. The pyrotechnic formulation 84 is loaded into the interior of the hollow tubular body 16 and the tubular body member 16 attached to the primer head assembly 14 by threading the reduced rearward portion 74 thereof into the enlarged bore portion 36 of the housing plug 18 until the rearwardly facing shoulder 86 at the rearward end of the tapering portion 76 of the body 10 abuts the forward end of the housing plug 18.

After the primer head assembly 14 and tubular body 16 are assembled with their respective ignition components and charges housed therein, the holes or perforations 82 in the wall of the tubular body 16 are covered with a lacquer to prevent the entrance of moisture. This is necessary because the various ignition charges are very hydroscopic and the presence of moisture will have an adverse effect upon the ignition charges, causing their degradation and possibly resulting in misfires. A suitable lacquer is a purple lacquer conforming to military specification MIL-L-296.

Figure 4:
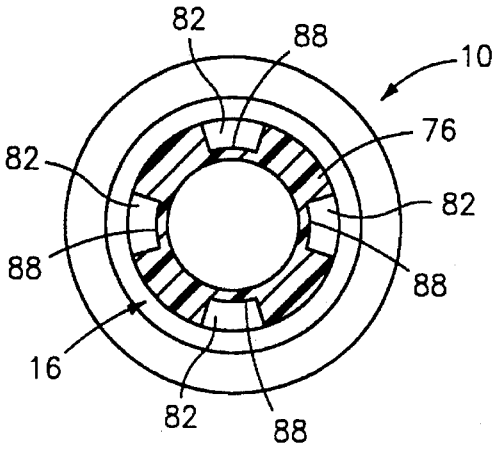
FIG. 4 is a sectional view of a primer, similar to the view of FIG. 3, but showing a modification of the present invention.

As an alternative to the provision of the lacquer coating over the hole or perforations 82, the perforations 82 may be molded such that there is a thin skin 88 covering the opening as shown in FIG. 4. This skin 88 may be on the order of between about 0.02 to about 0.04 inch thick. By integrally molding the skin 88 at the time of injection molding the body, an extra method step in the assembly of the primer is eliminated.

After the primer is assembled, it may be loaded into the cartridge case. In this operation, the body 16 is inserted through an opening in the base 12 into the propellant charge contained within the cartridge case until the threaded portion 22 of the primer head assembly 14 engages the threads 90 of the opening in the base 12. The primer 10 is then torqued by the use of an appropriate tool to thread the primer 10 into the base 12 until the flange 20 tightly abuts the base 12. The fact that the outer surface of the forward portion 74 of the body 16 is tapered and the forward end is provided with a screw driver tip 78 facilitates the insertion of the body 16 into the propellant.

While the invention had been described above with reference to a specific embodiment, it is apparent that many changes, modifications and variations can be made without departing from the inventive concept disclosed herein. Accordingly, it is intended to embrace all such changes, modifications and variations that fall within the scope of the appended claims.

What is claimed is:

1. A primer assembly comprising:

a. a primer head assembly attached to a cartridge case base, b. a hollow tubular one-piece body containing an ignition charge and extending into a propellant charge contained within the cartridge case base, an open rearward end of said body connected to said primer head assembly and an opposing closed forward end of said body terminating at a blade-shaped tip, and c. said body being comprised of a molded thermoplastic composite material.

2. The primer assembly of claim 1 wherein said thermoplastic composite material is filled with a mixture of carbon and glass.

3. The primer assembly of claim 1 wherein said body is injection molded.

4. The primer assembly of claim 3 wherein said body is composed of polyetheretherketone.

5. The primer assembly of claim 3 wherein said body is composed of polyphenylene sulfide.

6. The primer assembly of claim 1 wherein said rearward end of said body is threaded into said cartridge case base to a depth defined by a shoulder disposed between said rearward end and said forward end.

7. A primer assembly comprising:

a. a primer head assembly attached to a cartridge case base, and b. a hollow tubular one-piece body molded from a thermoplastic composite material containing an ignition charge and extending into a propellant charge contained within the cartridge case base, said body having an open rearward portion connected to said primer head assembly and a forward portion having an outer surface tapering to its smallest diameter at a forward end, said forward end terminating at a blade-shaped tip.

8. The primer assembly of claim 7 wherein said forward portion of said body tapers between about 1 to about 2 degrees.

9. The primer assembly of claim 7 wherein said body has a series of perforations in its wall.

10. The primer assembly of claim 9 wherein said perforations are covered by a skin of said thermoplastic composite material from which the body is made having a thickness of from about 0.02 inch to about 0.04 inch.

11. The primer assembly of claim 7 wherein said thermoplastic composite material is filled with both carbon and glass.

12. The primer assembly of claim 7 wherein said open rearward portion is threaded into said cartridge case base to a depth defined by a shoulder formed at a rearward end of said forward portion.

* * * * *